US008123506B2

(12) United States Patent
Schwartz et al.

(10) Patent No.: US 8,123,506 B2
(45) Date of Patent: Feb. 28, 2012

(54) ROTARY SLIDING VANE COMPRESSOR WITH A SECONDARY COMPRESSED FLUID INLET

(75) Inventors: Louis S. Schwartz, Bethlehem, PA (US); David Waage, Bethlehem, PA (US)

(73) Assignee: FLSmidth A/S (DK)

( * ) Notice: Subject to any disclaimer, the term of this patent is extended or adjusted under 35 U.S.C. 154(b) by 653 days.

(21) Appl. No.: 12/156,181

(22) Filed: May 29, 2008

(65) Prior Publication Data

US 2009/0297340 A1 Dec. 3, 2009

(51) Int. Cl.
*F04C 2/00* (2006.01)
*F04C 2/344* (2006.01)

(52) U.S. Cl. ..... 418/15; 418/228; 418/259

(58) Field of Classification Search ..... 418/15, 418/228, 236, 253, 259
See application file for complete search history.

(56) References Cited

U.S. PATENT DOCUMENTS

| | | | | |
|---|---|---|---|---|
| 1,804,604 | A * | 5/1931 | Gilbert | 418/15 |
| 1,893,171 | A * | 1/1933 | Kagi | 418/15 |
| 3,686,893 | A * | 8/1972 | Edwards | 418/86 |
| 3,977,852 | A * | 8/1976 | Edwards | 62/402 |
| 4,826,407 | A * | 5/1989 | Poole | 418/15 |
| 4,925,372 | A * | 5/1990 | Hansen | 418/15 |
| 6,824,370 | B2 * | 11/2004 | Takatsu | 418/236 |

FOREIGN PATENT DOCUMENTS

JP 58027895 A * 2/1983

* cited by examiner

*Primary Examiner* — Mary A Davis
(74) *Attorney, Agent, or Firm* — Daniel DeJoseph; Aaron M. Pile; Jeffrey A. Sharp

(57) ABSTRACT

The invention relates to increasing the fluid capacity and the fluid discharge pressure of a rotary sliding vane fluid compressor without significantly increasing the fluid discharge temperature. According to the invention supplemental air under pressure is added to a compressor's rotating pocket to increase the fluid capacity and fluid pressure in the pocket.

13 Claims, 7 Drawing Sheets

FIGURE 1 - PRIOR ART

ROTARY SLIDING VANE COMPRESSOR WITH A SECONDARY COMPRESSED FLUID INLET

The present invention relates to a method for increasing the fluid capacity and fluid exit pressures of sliding vane compressors without substantially increasing the heat of the compressed fluids exiting the compressor and a compressor that accomplishes this method.

BACKGROUND OF THE INVENTION

A "sliding" rotary vane compressor is a positive displacement machine that uses a rotor, which may be, but is not necessarily, eccentric, placed within a cylindrical chamber that is located within a rotor housing and is used to compress compressible fluids such as gases. The rotor has slots along its length, and each slot contains a blade, i.e. a vane. The vanes are thrown outwards by centrifugal force when the compressor is running and the vanes move in and out of the slot and follow the contour of the inner chamber wall. The vanes create individual cells of gas which, because of the vanes' movement, are compressed as the rotor turns. The vanes sweep the cylinder, sucking air in on one side and ejecting it on the other. As each cell approaches the discharge port, its volume is reduced and the compressed fluid is discharged.

A major concern with sliding vane compressors is discharge temperature, which must be controlled within reasonable limits to avoid serious mechanical damage to the compressor. Uncontrolled discharge temperature can lead to thermal growth of internal components causing jamming, internal components degrading or melting and lubrication failure. In addition, it is prudent to maintain discharge temperature of oil lubricated sliding vane compressors to about no greater than 350° F., although discharge temperatures lower than that are certainly desirable to minimize the disadvantages listed above, to limit the risk of oil fire. Furthermore, another practical limitation for oil lubricated and oil free compressors is the composition of the blade material. For example, the maximum temperature limits for resin bonded blade materials is also about 350° F., although some premium blade materials allow operation at slightly higher temperatures.

Oil drip lubricated and oil free sliding vanes follow the rules of isentropic compression, in which no heat is removed as the volume of the fluid is reduced and the pressure of the fluid rises. Gasses naturally heat when the volume is reduced and the pressure rises, and the greater the compression ratio, defined as the absolute outlet pressure divided by the absolute inlet pressure, the greater the outlet temperature.

Typically fluid is pulled into the compressor at the inlet at atmospheric pressure. The compression ratio of the compressor and discharge temperature of the compressor can be decreased, and the capacity of the compressor can be increased, if the fluid is inserted at the intake under pressure. This requires both larger size equipment and significally more power output since all of the air entering the intake must be pre-compressed. This is a more energy intensive solution than the proposed invention.

It is therefore an object of this invention to have a rotary vane compressor that provides increased capacity without a corresponding increase in size, decreased compression ratios and decreased fluid discharge temperatures with minimal increases in power requirements.

DESCRIPTION OF THE DRAWINGS

The above and other objects, features, and advantages will become more readily apparent from the following description, reference being made to the accompanying drawing in which:

FIGS. 1-4 are not necessarily drawn to scale.

DESCRIPTION OF THE INVENTION

The above and other objects are realized by the present invention wherein the performance of a rotary sliding vane compressor is improved by adding additional (supplemental) air under pressure to boost the pressure in a rotor pocket or cell through a supplemental second inlet located intermediate the first inlet and the outlet of the compressor in the direction of compressor rotation. Preferably the supplemental air is added in a rotor pocket as it immediately passes the first inlet of the compressor at the point of maximum pocket volume and before any substantial compression of the fluid within the compressor has occurred.

The total capacity of the compressor is the normal capacity of the cylinder plus the amount of boost air added. It is possible to substantially increase the discharge pressure while decreasing the discharge temperature due to the decrease in compression ratio over the sliding vane compressor cylinder and also by cooling the supplemental boost air prior to injecting it into the sliding vane cylinder. The advantage to adding pressurized boosting air as compared to pressurizing all the air at intake is the significant reduction in total horsepower used, since only the supplemental air is pressurized rather than all the air in the pocket. Another source of power savings is realized by pre-cooling the supplemental boost air.

Figure 1:
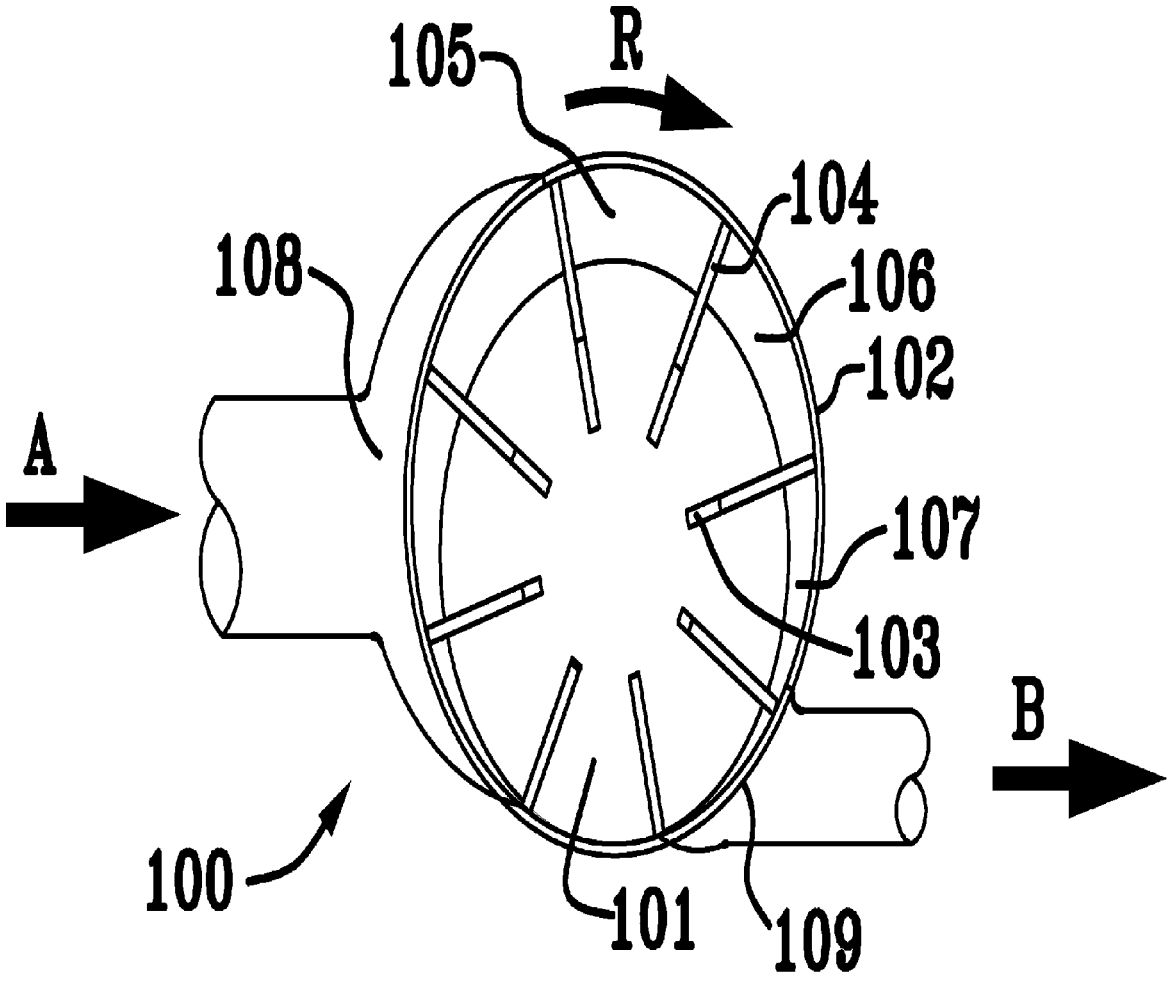
FIG. 1 depicts a partially cross sectional view of a prior art sliding vane compressor.

Referring to the drawings by characters of reference, in FIG. 1 prior art sliding vane compressor 100 is depicted, consisting of a housing in which there is enclosed an essentially cylindrical chamber 102 having an elongated cavity having a circular cross section, with a cylindrical rotor 101 having a circular cross section eccentrically and rotatably placed within chamber 102. Formed in rotor 101 is a plurality of radially extending grooves or slots 103 each of which accommodates a freely sliding blade or vane 104. The sliding vane compressor can utilize straight or angled rotor slots.

During rotation in the direction shown by arrow R of the rotor each vane 104 is thrown outwards by centrifugal force so that its outer edge sweeps the internal cylindrical surface of chamber 102. The free space between adjacent vanes is thus divided into closed cells (105, 106, 107). Inlet 108 and outlet 109 extend through housing 102. Air or other fluid at atmospheric pressure is taken in at stationary fluid inlet 108 in the direction of arrow A and is thus compressed as the free space in each cell diminishes as the rotor turns and the compressed air exits at stationary fluid outlet 109 in the direction of arrow B. Accordingly in the operation of a rotary vane compressor the closed cells to either side of any particular vane are at different pressures as the vane passes from the inlet port to the outlet port.

The present invention can be advantageously utilized on essentially any prior rotary vane compressor. Therefore, it can be used on rotary vane compressors having a rotor mounted in an elongated cavity which may be cylindrical with, for example, an essentially circular, elliptic, or epitrochoidal cross section formed therein. In certain prior art compressors the bore of the cavity can have an undercut in which the rotor sits lower in the housing in which case the cross section of the cavity would not be, for example, a perfect circle.

Figure 2:
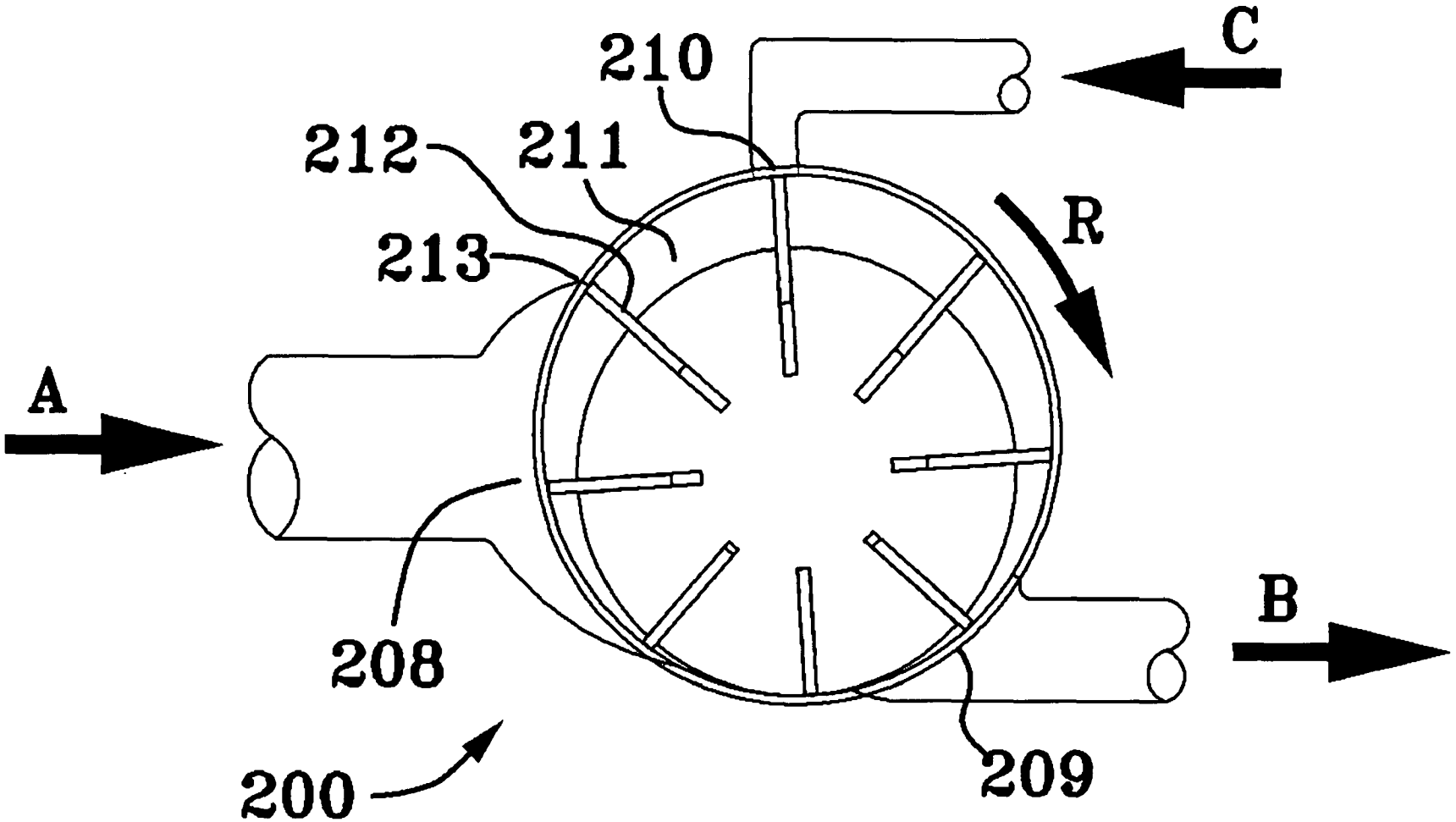
FIG. 2 depicts a partially cross sectional view of a first embodiment of sliding vane compressor of the invention.

FIG. 2 depicts one embodiment of the present invention, in which the compressor depicted is substantially similar to the compressor depicted in FIG. 1, with some significant variations. In the compressor of FIG. 2, air enters at first air inlet 208 and compressed air exits at outlet 209 in the same manner as depicted in FIG. 1. However, in the embodiment of the invention depicted in FIG. 2 supplemental boost air under pressure is injected in the direction depicted by arrow C through stationary second air inlet 210 and into pocket 211 of sliding vane compressor 200. Stationary second air inlet 210 is located, in the direction R of rotation of the rotor, after said first fluid inlet 208 and before said fluid outlet 209. In the depicted embodiment supplemental air is injected into pocket 211 directly after the trailing vane 212 of pocket 211 passes the closing edge 213 of inlet 208. At the point that supplemental air is injected into pocket 211, pocket 211 will be at its maximum volume, which volume will be gradually decreased as pocket 211 rotates in the direction of outlet 209. In an optional embodiment of the invention and as is depicted in FIG. 2, inlet 208 will be sized smaller than the corresponding prior art inlet 108 in FIG. 1. For example, inlet 108 in prior art compressor 100 encompasses three pockets, while the depicted inlet 208 in compressor 200 encompasses two pockets. The smaller inlet is a preferred embodiment of the present invention in order to provide room to have a "captive" pocket 211 formed into which boost air is injected sufficiently upstream from outlet 209 to provide for maximum compression of the air in pocket 211. Prior art compressors require a larger intake area than those of the present invention in order to increase the volume of air being compressed, a feature that is not required in the compressor of the present invention since the injection of supplemental air provides an optimal method of increasing capacity in the compressor.

Figure 3:
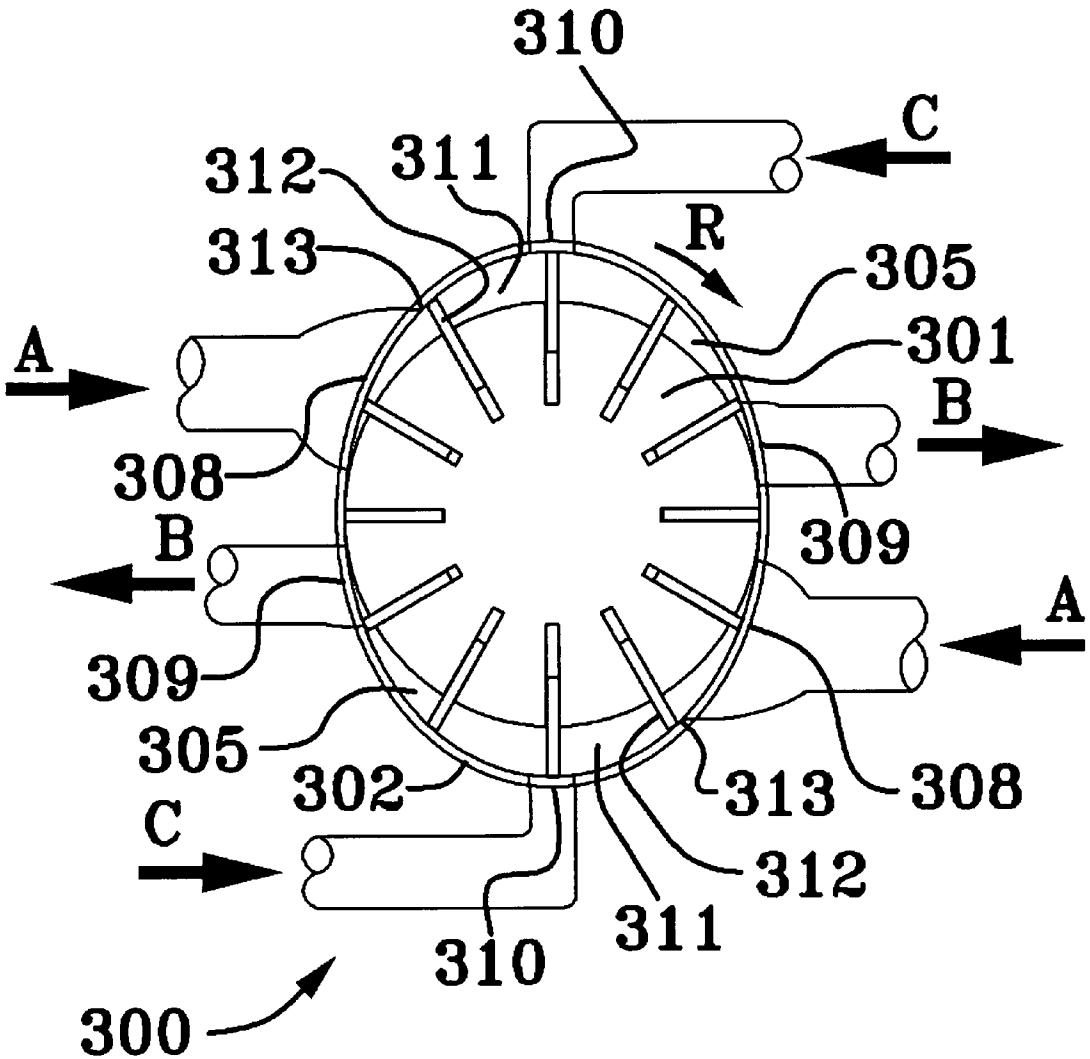
FIG. 3 depicts a partially cross sectional view of a second embodiment of sliding vane compressor of the invention.

FIG. 3 depicts another embodiment of the present invention is which a double sided compressor 300 is utilized. Double sided compressor 300 comprises rotor 301 having a circular cross section that is centrally, not eccentrically as in the compressor depicted in FIG. 2, located within cylindrical chamber 302. Cylindrical chamber 302 has an elliptical cross section which, when combined with the centrally placed rotor, results in there being two identical compression areas 305 located on opposite sides of the chamber. Other than having two compression chambers, compressor 300 functions identically to the compressor depicted in FIG. 2. The rotor rotates in the direction of arrow R. Air enters each compression area at inlet 308 in the direction of arrow A. Supplemental air under pressure is injected in the direction depicted by arrow C through boost air inlet 310 and into pocket 311 directly after the trailing vane 312 of pocket 311 passes the closing edge 313 of inlet 308. The volume of pocket 311 will be gradually decreased as it rotates in the direction of outlet 309, at which air will exit the compressor in the direction of arrow B.

The compressor depicted in FIG. 3 is commonly utilized on vane type hydraulic pumps and automotive power steering units.

The supplemental boost feature of the present invention can be utilized on compressors with 3 or 4 compression areas. If three compression areas are utilized, the cylindrical chamber will have a cross sectional shape forming a three lobe epitrochoid similar to a three leaf clover, and if four compression areas are utilized, the cylindrical chamber will have a cross sectional shape forming a four lobe epitrochoid similar to a four leaf clover.

The number of pockets in compressors with one compression area will typically range from about 4 to about 12, although more pockets can be utilized. When a compressor has more than one compression area the number of pockets will generally increase over compressor having one compression area.

Figure 4:
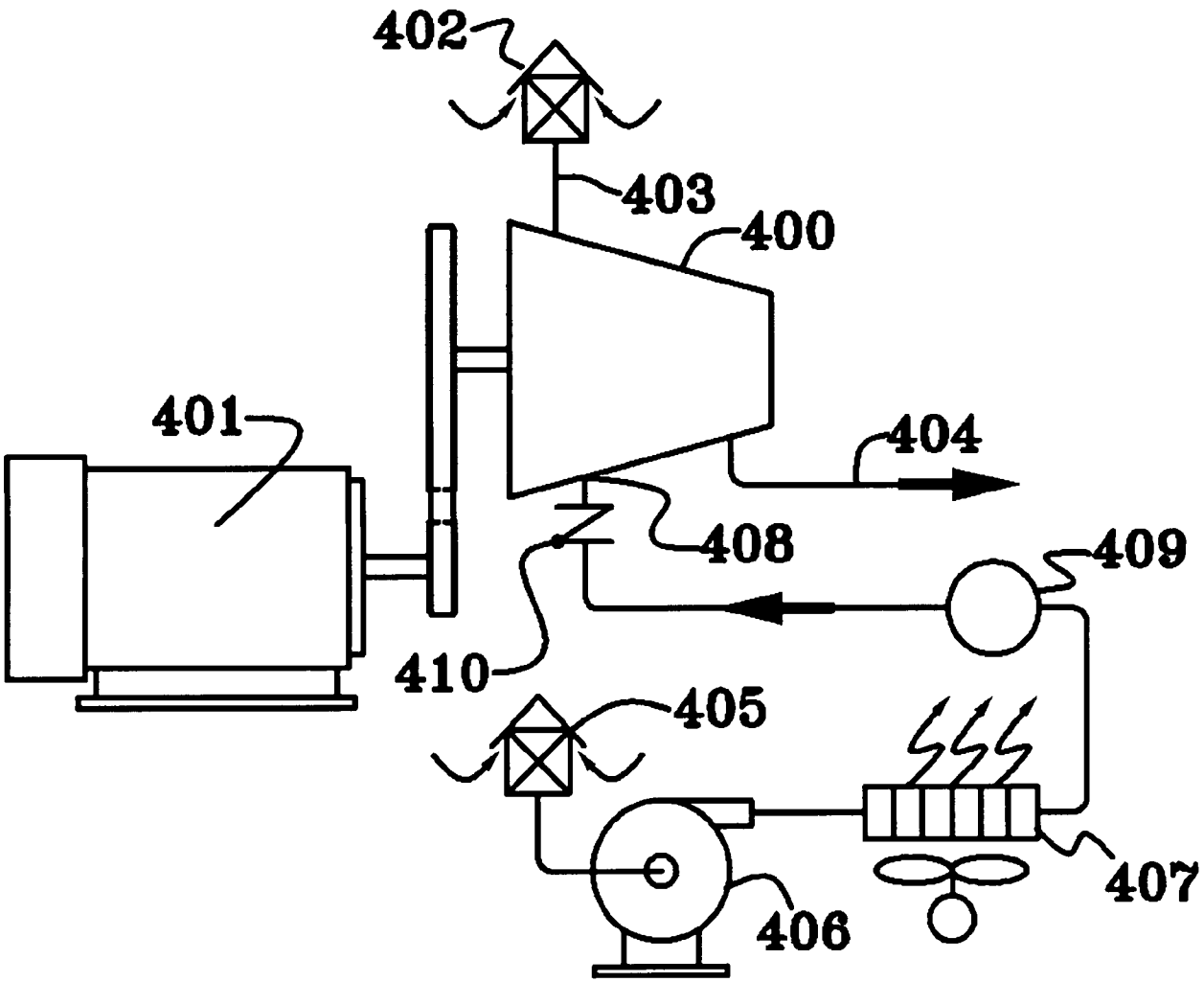
FIG. 4 is a flow schematic of the present invention.

FIG. 4 depicts a flow schematic of the compressor system of the present invention in which the fluid compressed is air. Sliding vane compressor 400 is powered by main motor 401. Ambient air, which initially passes through inlet air filter 402, is introduced into compressor 400 via inlet line 403. Compressed air is discharged via outlet line 404. Supplemental air passes through filter 405, and is compressed, i.e. pressurized, by blower 406. Although any means of compression may be utilized, it is preferred to use a regenerative blower, multistage fan, or positive displacement blower. The preferred boost pressure range is from about 4 to about 20 psi above atmospheric, that is, the pressure of air within the pocket will by boosted by from about 4 psi to about 20 psi by the addition of supplemental air, although there is benefits even in providing boost air at pressures lower than 4 psi. Most preferably the boost air pressure range will be from about 4 to about 10 psi. After being compressed, the pressurized supplemental air is thereafter preferably passed through cooler 407 to remove the heat of compression before being injected into the sliding vane compressor cylinder via inlet 408. The cooled compressed air may be thereafter stored in an optional reservoir tank 409 to optimize injection flow. Optional check valve 410 may be utilized to prevent back flow of compressed air into the cooler and blower in the event the blower stops while the sliding vane compressor continues to run. Any type of cooler that can take the process conditions can be used. Typically, if it is air cooled, the cooler can be an aluminum core radiator with integral fan. If it is air to liquid (liquid cooled), a shell and tube cooler can be used.

The present invention permits compressor operation at discharge pressures in excess of 60 psi, whereas 40 psi is the current accepted limit for large single stage sliding vane machines that are not oil flooded.

Figure 5:
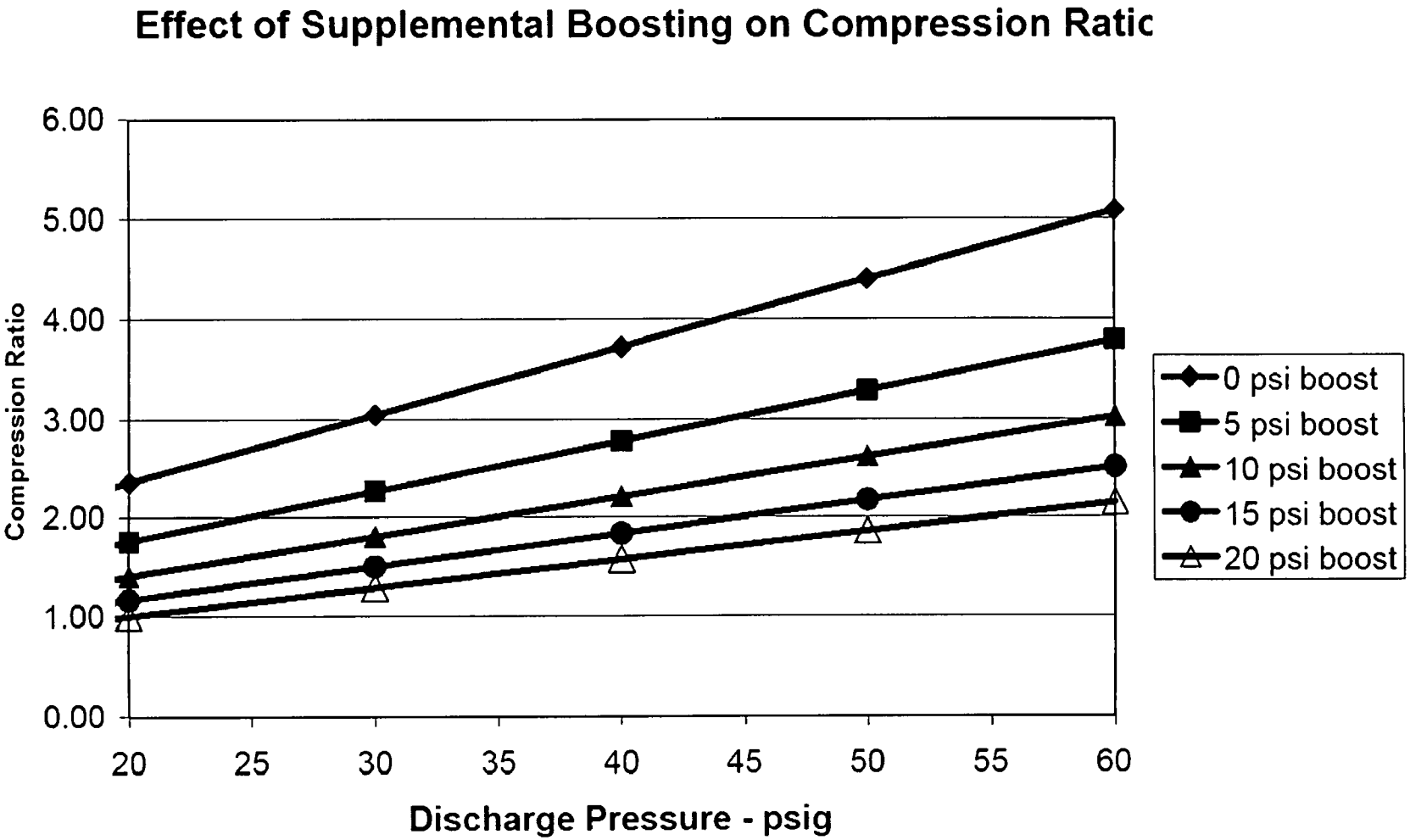
FIG. 5 is a graph illustrating the compression ratio as a function of discharge pressure at various levels of boost air into the sliding vane compressor.
Figure 6:
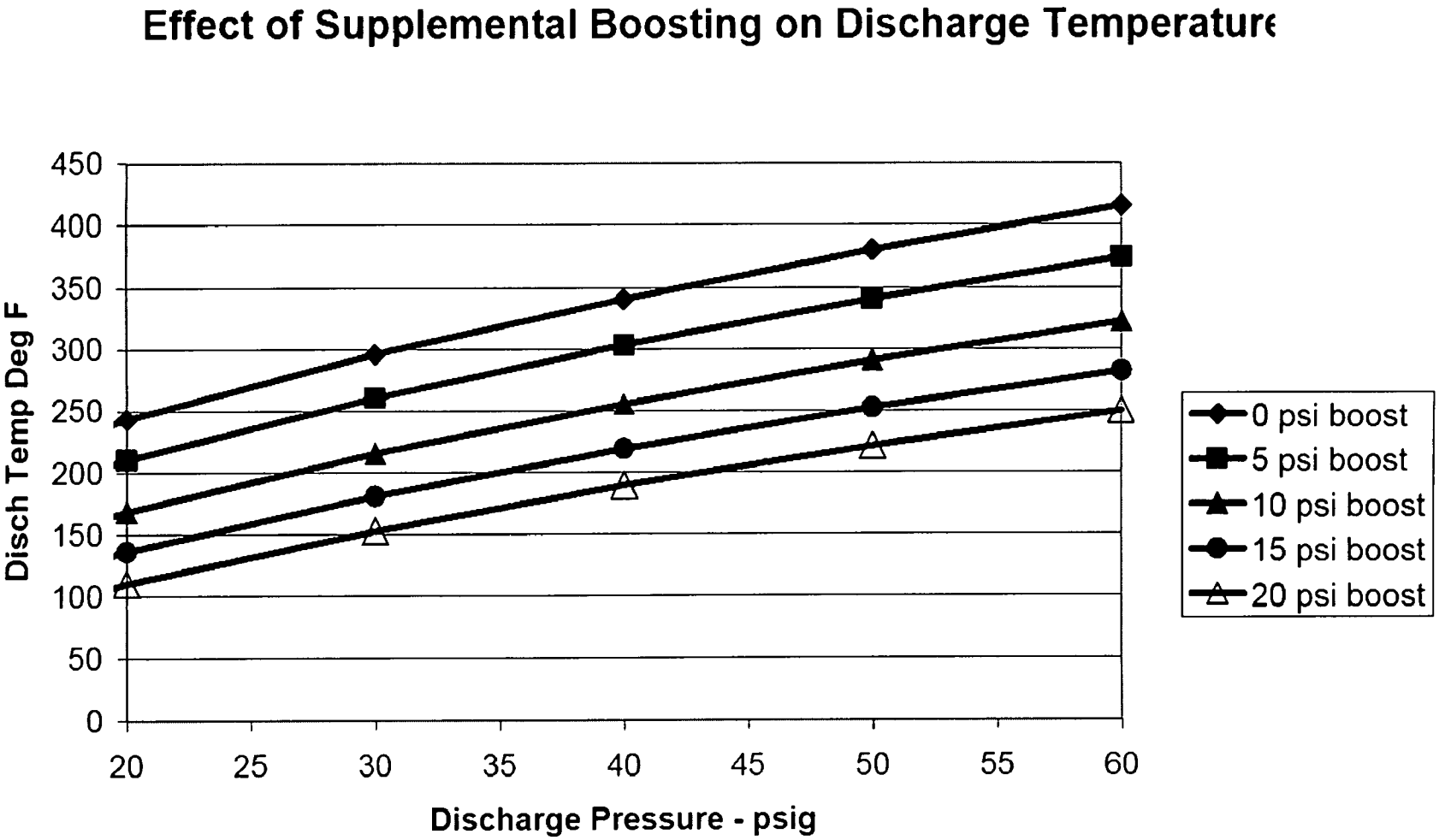
FIG. 6 is a graph illustrating the discharge temperature as a function of discharge pressure at various levels of boost air into the sliding vane compressor.
Figure 7:
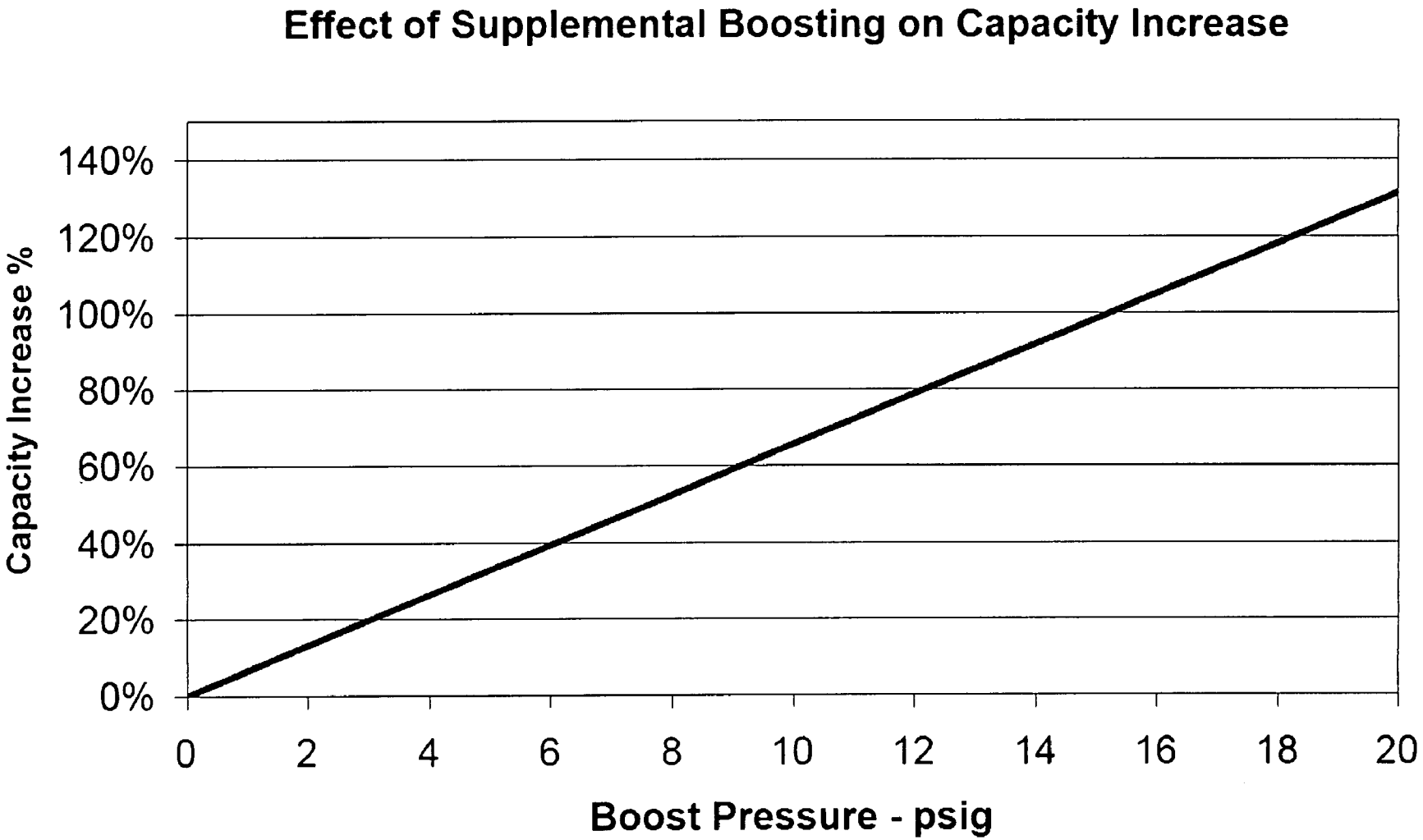
FIG. 7 is a graph illustrating the increase in capacity of a sliding vane compressor as a function of boost air into the sliding vane compressor.

FIGS. 5-7 are graphs illustrating the benefits of the above invention. The conditions assumed in FIGS. 5-7 are (i) pure isentropic compression; (ii) the discharge temperature does not include blade friction or heat generated by slip leakage, (iii) with all heat from blade friction and slip removed by the cooling water jacket, and (iv) the intake air temperature (ambient) is 90° F., the boost air temperature is 110° F. and the compressor is at sea level.

FIG. 5 is a graph illustrating the compression ratio as a function of discharge pressure at various levels of boost air into the sliding vane compressor. As FIG. 5 depicts, there is a significant reduction of compression ratios at discharge pressures of 60 psig when supplemental boost air at 10 psi is added to the compressor. With a 10 psi boost, the compression ratio is 3.00 at a discharge pressure of 60 psig, while in a normal compressor that does not utilize the boost air the compression ratio at a discharge pressure of 60 psig is slightly over 5.00.

The effect of the differences in compression ratio on discharge temperature is illustrated in FIG. 6. With a 10 psi boost, the discharge temperature is approximately 320° F. at a discharge pressure of 60 psig, while without the boost air the discharge temperature is approximately 415° F. at a discharge pressure of 60 psig. All the boost air added will increase the capacity of the compressor. Obviously, as the pressure of the boost air is increased more air will be added to a given pocket.

FIG. 7 shows the increase in capacity (free air displaced) with the increase in boost pressure. With a 10 psi boost there is shown an increase in compressor capacity of approximately 64%. With a 15 psi boost there is an increase in compressor capacity of approximately 100%.

The compressor of the present invention is adaptable to be utilized with any type of compressible fluid, including gases such as air, digester gas, nitrogen and carbon dioxide.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed is:

1. A sliding vane rotary compressor comprising:

a) a housing having an elongated cavity formed therein;

b) a rotor mounted in the elongated cavity for rotation in said elongated cavity; said rotor having radially extending rotor vanes slidably carried in the outer surface thereof to engage the walls of said elongated cavity to form, between adjacent rotor vanes, a plurality of rotable pockets for the compression of fluid and the resultant increase of fluid pressure, with said rotor vanes being radially movable to change the volumetric capacity of said plurality of rotable pockets as they rotate within the elongated cavity;

c) a stationary first fluid inlet for fluid to be compressed, a stationary second fluid inlet and a stationary fluid outlet, with each of said stationary first fluid inlet, said stationary second fluid inlet and said stationary fluid outlet extending through the housing and being in fluid communication with the plurality of rotable pockets, and with the stationary second fluid inlet being located, in the direction of rotation of the rotor, after said stationary first fluid inlet and before said stationary fluid outlet;

d) means to insert a first amount of fluid through said stationary first fluid inlet and into one of the plurality of rotable pockets as said one of the plurality of rotable pockets rotates into fluid communication with said stationary first fluid inlet; and e) means to insert a second amount of fluid under pressure through said stationary second fluid inlet and into said one of the plurality of rotable pockets as said one of the plurality of rotable pockets rotates into fluid communication with said stationary second fluid inlet, said second amount of fluid combining with said first amount of fluid to thereby increase the fluid capacity and boost the fluid pressure in said one of the plurality of rotable pockets;

wherein (i) the volumetric capacity of the plurality of rotable pockets approaches a minimum as said plurality of rotable pockets approach said stationary fluid outlet to thereby compress the fluid within said plurality of rotable pockets and (ii) the volumetric capacity of said plurality of rotable pockets approaches a maximum as said plurality of rotable pockets are in communication with said stationary second fluid inlet.

2. The sliding vane rotary compressor of claim 1 wherein the elongated cavity is essentially cylindrical having a circular or elliptic cross section.

3. The sliding vane rotary compressor of claim 1 wherein the rotor is eccentrically mounted within the elongated cavity and the elongated cavity has a circular cross section.

4. The sliding vane rotary compressor of claim 1 wherein the rotor is centrally mounted within the elongated cavity, the elongated cavity has an elliptical cross section and there are two areas for fluid compression on opposite sides of the elongated cavity, with each area having a said stationary first and second fluid inlet and said stationary fluid outlet.

5. The sliding vane rotary compressor of claim 1 further comprising means to cool the pressurized fluid before it is inserted through said stationary second fluid inlet.

6. The sliding vane rotary compressor of claim 1 wherein the fluid is air.

7. A sliding vane rotary compressor comprising:

a) a housing having an cylindrical cavity formed therein, said cylindrical cavity having a circular cross section;

b) a rotor eccentrically mounted in the cylindrical cavity for rotation in said cylindrical cavity; said rotor having radially extending rotor vanes slidably carried in the outer surface thereof to engage the walls of said cylindrical cavity to form, between adjacent rotor vanes, a plurality of rotable pockets for the compression of fluid and the resultant increase of fluid pressure, with said rotor vanes being radially movable to change the volumetric capacity of said plurality of rotable pockets as they rotate within the cylindrical cavity;

c) a stationary first fluid inlet for fluid to be compressed, a stationary second fluid inlet and a stationary fluid outlet, with each of said stationary first fluid inlet, said stationary second fluid inlet and said stationary fluid outlet extending through the housing and being in fluid communication with the plurality of rotable pockets, and with the stationary second fluid inlet being located, in the direction of rotation of the rotor, after said stationary first fluid inlet and before said stationary fluid outlet;

d) means to insert a first amount of fluid through said stationary first fluid inlet and into a one of the plurality of rotable pockets as said one of the plurality of rotable pockets rotates into fluid communication with said stationary first fluid inlet;

e) means to insert a second amount of fluid under pressure through said stationary second fluid inlet and into said one of the plurality of rotable pockets as said one of the plurality of rotable pockets rotates into fluid communication with said stationary second fluid inlet, said second amount of fluid combining with said first amount of fluid to thereby increase the fluid capacity and boost the fluid pressure in said one of the plurality of rotable pockets; and f) means to cool the pressurized fluid before it is inserted through said stationary second fluid inlet, wherein the volumetric capacity of the plurality of rotable pockets approaches a maximum as said plurality of rotable pockets are in communication with said stationary second fluid inlet and approaches a minimum as said plurality of rotable pockets approach said stationary fluid outlet to thereby compress the fluid within said plurality of rotable pockets.

8. The sliding vane rotary compressor of claim 7 wherein the fluid is air.

9. A method of increasing the fluid capacity and the fluid discharge pressure of a rotary sliding vane fluid compressor including a housing having an cylindrical cavity, a fluid inlet for inserting fluid to be compressed and an outlet for compressed fluid, a rotor located within the cavity, vanes radially spaced apart and extending from the rotor to define rotating pockets to transport fluid from the fluid inlet to the outlet, including the steps of a) inserting a first amount of fluid to be compressed into a one of said rotating pockets via the fluid inlet; and b) inserting a second amount of said fluid under pressure into said one of the rotating pockets at a point after the fluid inlet but prior to the outlet in the direction of rotation of the pocket when the volumetric capacity of said pocket approaches a maximum, to thereby combine said second amount of fluid with said first amount of fluid to thereby increase the fluid capacity and boost the fluid pressure in said pocket.

10. The method of claim 9 further comprising cooling the pressurized fluid prior to the insertion step.

11. The method of claim 9 wherein the pressurized fluid is inserted at a pressure ranging from about 4 psi to about 20 psi.

12. The method of claim 11 wherein the pressurized fluid is inserted at a pressure ranging from about 4 psi to about 10 psi.

13. The method of claim 9 wherein the fluid is air.

* * * * *